US009417593B2

(12) United States Patent
Umimura

(10) Patent No.: US 9,417,593 B2
(45) Date of Patent: Aug. 16, 2016

(54) IMAGE FORMING APPARATUS CONFIGURED TO SWITCH BETWEEN SUPPLYING AND SHUTTING-OFF OF POWER TO A PORTION OF THE IMAGE FORMING APPARATUS

(71) Applicant: CANON KABUSHIKI KAISHA, Tokyo (JP)

(72) Inventor: Kiyokazu Umimura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/314,307

(22) Filed: Jun. 25, 2014

(65) Prior Publication Data

US 2015/0003850 A1 Jan. 1, 2015

(30) Foreign Application Priority Data

Jun. 28, 2013 (JP) ..... 2013-136175

(51) Int. Cl.
*G03G 15/00* (2006.01)

(52) U.S. Cl.
CPC ..... *G03G 15/80* (2013.01); *G03G 15/5004* (2013.01)

(58) Field of Classification Search
CPC ..... G03G 15/5004; G03G 15/80; G03G 2215/00978
USPC ..... 399/37, 88
See application file for complete search history.

(56) References Cited

U.S. PATENT DOCUMENTS

| | | | | |
|---|---|---|---|---|
| 5,608,275 | A * | 3/1997 | Khosrowpour | 307/130 |
| 5,654,859 | A * | 8/1997 | Shi | 361/66 |
| 8,271,819 | B2 * | 9/2012 | Breen et al. | 713/330 |
| 2004/0189094 | A1 * | 9/2004 | Hori | 307/29 |
| 2007/0280720 | A1 * | 12/2007 | Kimura | 399/88 |
| 2008/0199203 | A1 * | 8/2008 | Seo | G03G 15/5004 399/88 |
| 2009/0066161 | A1 * | 3/2009 | Lu et al. | 307/66 |
| 2010/0237705 | A1 * | 9/2010 | Klamm | 307/87 |
| 2015/0003856 | A1 * | 1/2015 | Umimura | 399/88 |

FOREIGN PATENT DOCUMENTS

| | | | |
|---|---|---|---|
| JP | 2001-109546 | A | 4/2001 |
| JP | 2008023218 | A * | 2/2008 |
| JP | 2013051777 | A * | 3/2013 |

* cited by examiner

*Primary Examiner* — Robert Beatty
(74) *Attorney, Agent, or Firm* — Canon USA, Inc., IP Division

(57) ABSTRACT

An image forming apparatus includes a first power supply unit to output first output power, a first device to which the first output power is supplied, a second power supply unit to output second output power, a second device to which the second output power is supplied, a detection unit to detect an overcurrent of the second power supply unit, a power source control unit to which the first output power is supplied and to switch between supplying and shutting-off of the second output power to the second device, and a control unit to which the first output power is supplied and to control an operation of the power source control unit. When the detection unit detects an overcurrent of the second output power, the power source control unit shuts off the second output power to the second device, and the control unit executes finish processing for the first device.

12 Claims, 7 Drawing Sheets

FIG.4

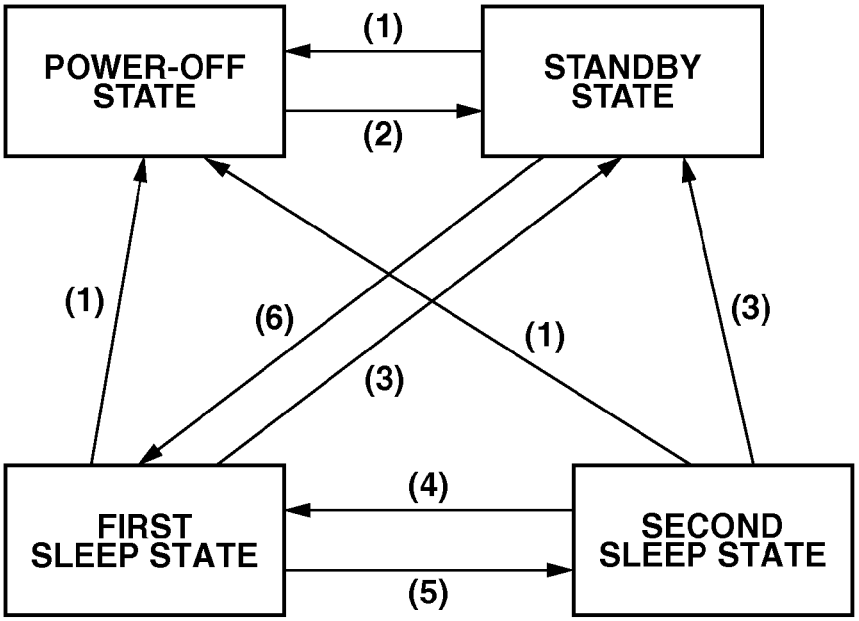

(1) POWER SWITCH IS TURNED OFF.
(2) POWER SWITCH IS TURNED ON.
(3) PDL PRINT JOB IS RECEIVED.
(4) PACKET TO WHICH PROXY RESPONSE CANNOT BE PERFORMED IS RECEIVED, OR ONE OF BUTTONS 121 OF OPERATION UNIT 12 IS PRESSED.
(5) PREDETERMINED TIME HAS ELAPSED WITH BUTTONS 121 NOT OPERATED AND PREDETERMINED TIME HAS ELAPSED WITH NO PDL PRINT JOB RECEIVED.
(6) POWER-SAVING BUTTON 121C, WHICH IS ONE OF THE BUTTONS 121, IS PRESSED.

FIG.5

| | POWER SOURCE CONTROL UNIT | RAM | LAN CONTROLLER | OPERATION UNIT (BUTTONS) | CPU | ROM | HDD | OPERATION UNIT (DISPLAY UNIT) | IMAGE PROCESSING UNIT | PRINTER IMAGE PROCESSING UNIT | SCANNER IMAGE PROCESSING UNIT | PRINTER CONTROL UNIT | PRINTER DRIVE UNIT | SCANNER CONTROL UNIT | SCANNER DRIVE UNIT |
|---|---|---|---|---|---|---|---|---|---|---|---|---|---|---|---|
| POWER-OFF STATE | OFF | OFF | OFF | OFF | OFF | OFF | OFF | OFF | OFF | OFF | OFF | OFF | OFF | OFF | OFF |
| SUSPEND STATE | ON | ON | OFF | OFF | OFF | OFF | OFF | OFF | OFF | OFF | OFF | OFF | OFF | OFF | OFF |
| SECOND SLEEP STATE | ON | ON | ON | ON | OFF | OFF | OFF | OFF | OFF | OFF | OFF | OFF | OFF | OFF | OFF |
| FIRST SLEEP STATE | ON | ON | ON | ON | ON | ON | ON | OFF | OFF | OFF | OFF | OFF | OFF | OFF | OFF |
| STANDBY STATE | ON | ON | ON | ON | ON | ON | ON | ON | ON | ON | ON | ON | ON | ON | ON |

IMAGE FORMING APPARATUS CONFIGURED TO SWITCH BETWEEN SUPPLYING AND SHUTTING-OFF OF POWER TO A PORTION OF THE IMAGE FORMING APPARATUS

BACKGROUND OF THE INVENTION

1. Field of the Invention

The present invention relates to an image forming apparatus including a detection unit that detects an overcurrent.

2. Description of the Related Art

An image processing apparatus (image forming apparatus) which stops supplying power to a printer unit to reduce standby power consumption during standby in which a printing function is not executed (Japanese Patent Application Laid-Open No. 2001-109546), is known. The image processing apparatus discussed in Japanese Patent Application Laid-Open No. 2001-109546 includes a slave CPU, to which a first power supply unit supplies power regardless of a state (an on/off state) of a power switch operated by a user. The image processing apparatus also includes a master CPU, to which a second power supply unit supplies power when the power switch is on. In addition to the master CPU, the second power supply unit also supplies power to a copy function control unit that controls a copy function of the image processing apparatus.

This image processing apparatus discussed in Japanese Patent Application Laid-Open No. 2001-109546 enables the master CPU to execute turn-off processing, such as data saving processing, when the user turns off the power switch. When the turn-off processing is finished, the master CPU instructs the slave CPU to turn off power to the image processing apparatus. The slave CPU, which has received the instruction, turns off a switch arranged between the commercial power and the second power supply unit. This stops power supply from the grid power to the second power supply unit, stopping power supply to the master CPU and the copy function control unit.

A short circuit, which may be caused by reasons such as a failure of an electronic component to which the second power supply unit supplies power, would lead to passage of an excessive current if the second power supply unit maintains the output voltage. A solution typically provided for such an excessive current passing from the second power supply unit is a mechanism (a protective circuit) to shut off the passage of current from the second power supply unit. The image processing apparatus discussed in Japanese Patent Application Laid-Open No. 2001-109546 shuts off power supply from the second power supply unit by such a protective circuit in a case of a short circuit of an electronic component in the copy function control unit due to reasons such as a failure. This shuts off power supply to the master CPU, to which the second power supply unit supplies power. In other words, this image processing apparatus discussed in Japanese Patent Application Laid-Open No. 2001-109546 shuts off the power supply to the master CPU immediately when an overcurrent flows due to reasons such as a short circuit in an electronic component of a device to which the second power supply unit supplies power. Thus, in this image processing apparatus discussed in Japanese Patent Application Laid-Open No. 2001-109546, power supply to the master CPU is stopped without the master CPU performing the turn-off processing described above. As a result, data prior to the occurrence of the short circuit may be erased without being saved.

SUMMARY OF THE INVENTION

According to an aspect of the present invention, an image forming apparatus is capable of stopping power supply from a second power supply unit when an overcurrent flows from the second power supply unit, and preventing the image forming apparatus from losing data by a control unit, to which power is supplied from a first power supply unit, executing finish processing.

According to an exemplary embodiment of the invention, an image forming apparatus includes a first power supply unit configured to output first output power, a first device to which the first output power is supplied from the first power supply unit, a second power supply unit configured to output second output power, a second device to which the second output power is supplied from the second power supply unit, a detection unit configured to detect an overcurrent of the second power supply unit, a power source control unit to which the first output power is supplied from the first power supply unit, and configured to switch between supplying and shutting-off of the second output power to the second device, and a control unit to which the first output power is supplied from the first power supply unit, and configured to control an operation of the power source control unit, wherein, when the detection unit detects an overcurrent of the second output power, the power source control unit shuts off the second output power from the second power supply unit to the second device, and the control unit executes finish processing for the first device.

Further features of the present invention will become apparent from the following description of exemplary embodiments with reference to the attached drawings.

BRIEF DESCRIPTION OF THE DRAWINGS

FIG. 4 is a power state transition diagram of the image forming apparatus.

FIG. 5 is a diagram illustrating a state of each unit at different power states.

DESCRIPTION OF THE EMBODIMENTS

Exemplary embodiments of the invention will now be described with reference to the drawings.

<Overall Configuration of Image Forming Apparatus>

Figure 1:
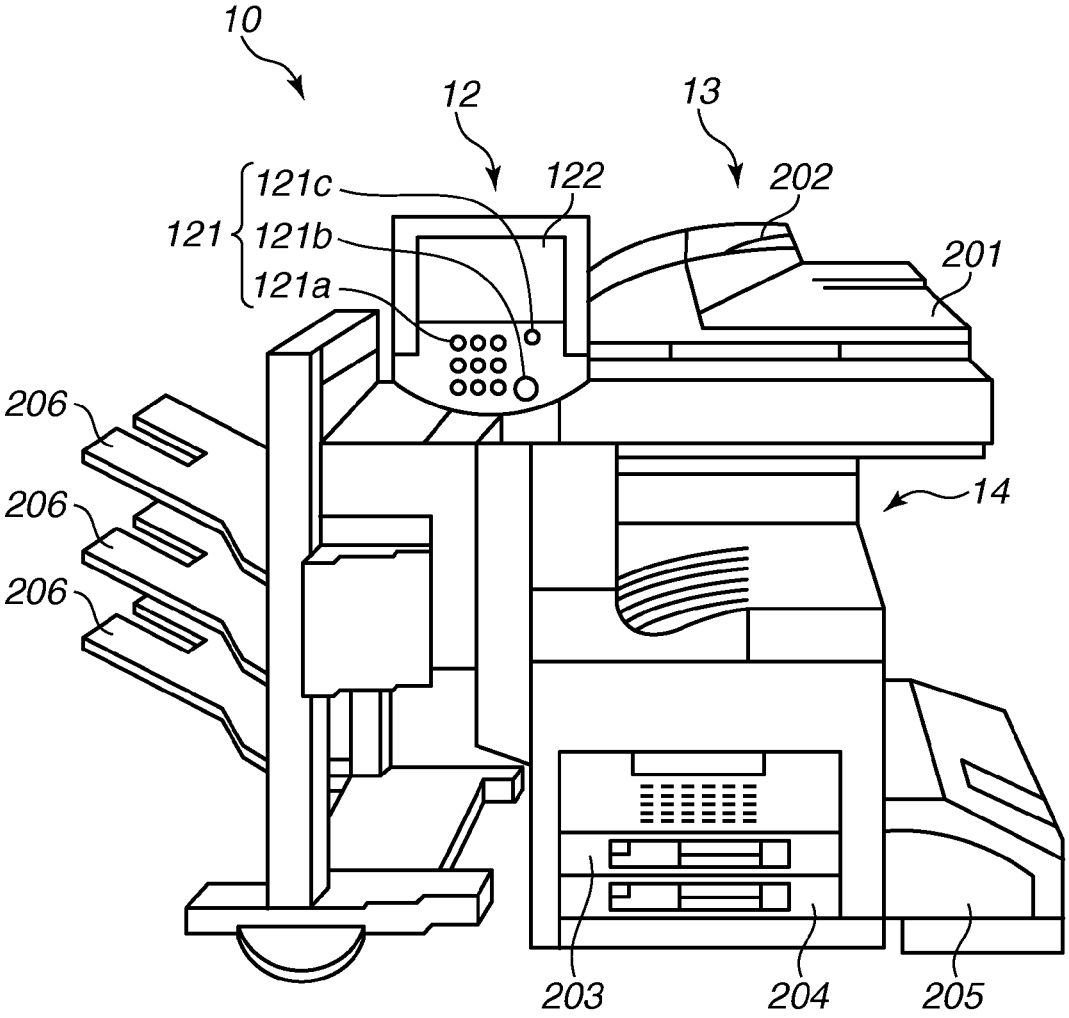
FIG. 1 is a perspective view of an image forming apparatus according to a first exemplary embodiment.

FIG. 1 is a diagram illustrating an external appearance of an image forming apparatus according to a first exemplary embodiment of the present invention.

As illustrated in FIG. 1, an image forming apparatus 10 includes an operation unit 12, which is a user interface (UI), a scanner unit 13, which is an image input device, and a printer unit 14, which is an image output device.

The operation unit 12 includes various buttons 121 to be operated by a user and a display unit 122 to display an image. The display unit 122 displays screens, such as a status screen to display a status of the image forming apparatus 10 and a setting screen for the user to input information needed to execute a copy function and a fax function. The buttons 121 include a button 121*a* to allow inputting of the number of print copies and the like, a start button 121*b* to start copying, fax transmission, or the like, and a power-saving button 121*c* to cause the image forming apparatus 10 to transition to a low power state (a first sleep state to be described below).

The scanner unit 13 is a device to scan an image formed on an original to acquire image data. Light radiated to the image on the document is reflected to a charge-coupled device (CCD) to convert information of the image into electric signals. These electric signals are converted into luminance signals of R, G, and B colors to be output to a controller 11 (described below).

Originals to be scanned by the scanner unit 13 are set in a tray 202 of a document feeder 201. When the user inputs an instruction to start scanning through the operation unit 12, the scanner unit 13 causes the document feeder 201 to feed the documents one at a time from the tray 202 for scanning. Note that the scanner unit 13 may move a carriage including a light source and a CCD sensor to scan a document placed on a glass surface (not illustrated), in place of the automatic feeding by the document feeder 201.

The printer unit 14 is a device to form an image on a sheet using input image data. Although the printer unit 14 according to the present exemplary embodiment forms an image through an electrophotographic process using a photosensitive drum or a photosensitive belt, the invention is not limited thereto. The printer unit 14 may be, for example, of the inkjet type, which ejects ink through a small nozzle array for printing on a sheet.

The image forming apparatus 10 also includes a plurality of sheet cassettes 203, 204, and 205 to store sheets, on which images are formed by the printer unit 14. The image forming apparatus 10 further includes a plurality of sheet cassette discharge trays 206, onto which sheets with images formed thereon by the printer unit 14 are discharged.

<Controller 11 of Image Forming Apparatus 10>

Figure 2:
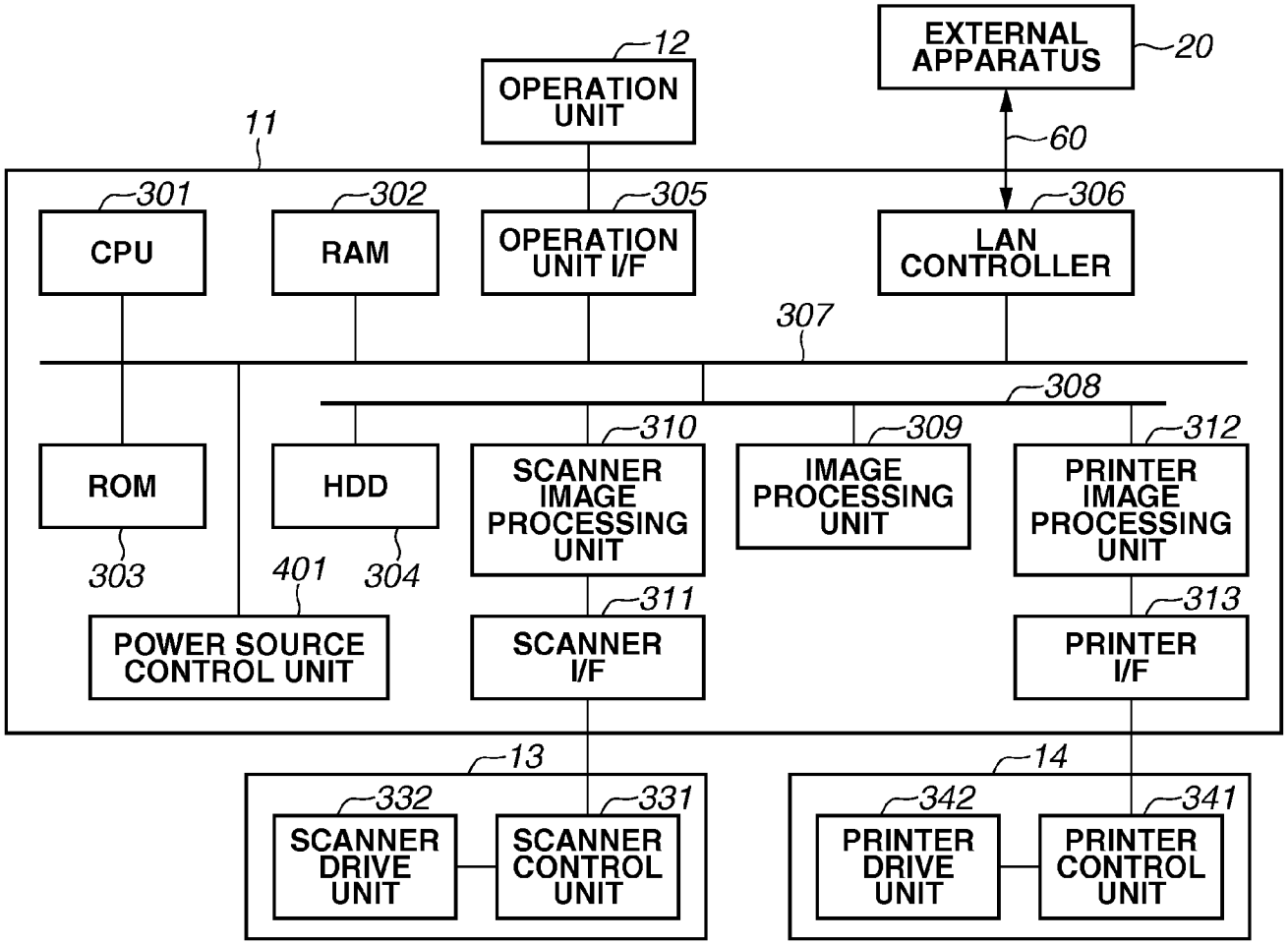
FIG. 2 is a block diagram illustrating a controller of the image forming apparatus.

With reference to FIG. 2, the controller 11, which controls overall operations of the image forming apparatus 10, will now be described in detail.

As illustrated in FIG. 2, the controller 11 is electrically connected to the scanner unit 13, the printer unit 14, and the operation unit 12. The controller 11 includes a central processing unit (CPU) 301, a random-access memory (RAM) 302, a read-only memory (ROM) 303, an operation unit interface (I/F) 305, a local area network (LAN) controller 306, and a power source control unit 401. The CPU 301, the RAM 302, the ROM 303, the operation unit I/F 305, the LAN controller 306, and the power source control unit 401 are connected to a system bus 307. The controller 11 also includes a hard disk drive (HDD) 304, an image processing unit 309, a scanner image processing unit 310, and a printer image processing unit 312. The HDD 304, the image processing unit 309, the scanner image processing unit 310, and the printer image processing unit 312 are connected to an image bus 308.

The CPU 301 collectively controls access to various devices connected thereto based on a control program and the like stored in the ROM 303. The CPU 301 also controls various types of processing executed by the controller 11.

The RAM 302 is a system work memory used by the CPU 301 to operate. The RAM 302 is also a memory to store image data temporarily. The RAM 302 includes a static random-access memory (SRAM) capable of retaining the stored contents when power is off, and a dynamic random-access memory (DRAM) in which the stored contents are erased when power is off. The ROM 303 stores an apparatus boot program. The HDD 304 stores system software and image data.

The operation unit I/F 305 is an interface to connect the system bus 307 and the operation unit 12. The operation unit I/F 305 receives from the system bus 307 image data to be displayed on the operation unit 12, and outputs the data to the operation unit 12. The operation unit I/F 305 also outputs to the system bus 307 information input from the operation unit 12.

The LAN controller 306 controls the input and output of information between the image forming apparatus 10 and an external apparatus 20 connected to a LAN 60.

The power source control unit 401 controls power supply to each unit of the image forming apparatus 10. The power source control unit 401 will be described in detail below.

The image bus 308 is a transmission path through which image data is transmitted and received, and is made up of a peripheral component interconnect (PCI) bus, an IEEE1394 bus, or the like.

The image processing unit 309 performs image processing, such as reading image data stored in the RAM 302, enlarging and reducing a size of an image of Joint Photographic Experts Group (JPEG), Joint Bi-level Image Experts Group (JBIG), etc., and adjusting colors. The scanner image processing unit 310 corrects, processes, and edits image data received via the scanner I/F 311 from the scanner unit 13. The scanner image processing unit 310 determines whether the received image data is of a color document or a black and white document and whether the data is of a text document or a photographic document. The scanner image processing unit 310 then adds a result of the determination to the image data. Such additional information is referred to as attribute data. The printer image processing unit 312 refers to the attribute data attached to the image data to perform image processing on the image data. The image data that has been subjected to the image processing is output via a printer I/F 313 to the printer unit 14.

The scanner unit 13 includes a scanner control unit 331 and a scanner drive unit 332. The scanner drive unit 332, which is a physically driving device, includes a sheet conveyance motor to convey a document set in the tray 202 to a reading position of the scanner unit 13. The scanner control unit 331 controls the operation of the scanner drive unit 332. The scanner control unit 331 receives through communication with the CPU 301 setting information set by the user to perform scanning processing, and controls the operation of the scanner drive unit 332 according to the setting information.

The printer unit 14 includes a printer control unit 341 and a printer drive unit 342. The printer drive unit 342, which is a physically driving device, includes a fixing device and a sheet conveyance motor (not illustrated). The printer control unit 341 controls the operation of the printer drive unit 342. The printer control unit 341 receives through communication with the CPU 301 setting information set by the user to perform printing processing, and controls the operation of the printer drive unit 342 according to the setting information.

<Power Source Unit 40 of Image Forming Apparatus 10>

Figure 3:
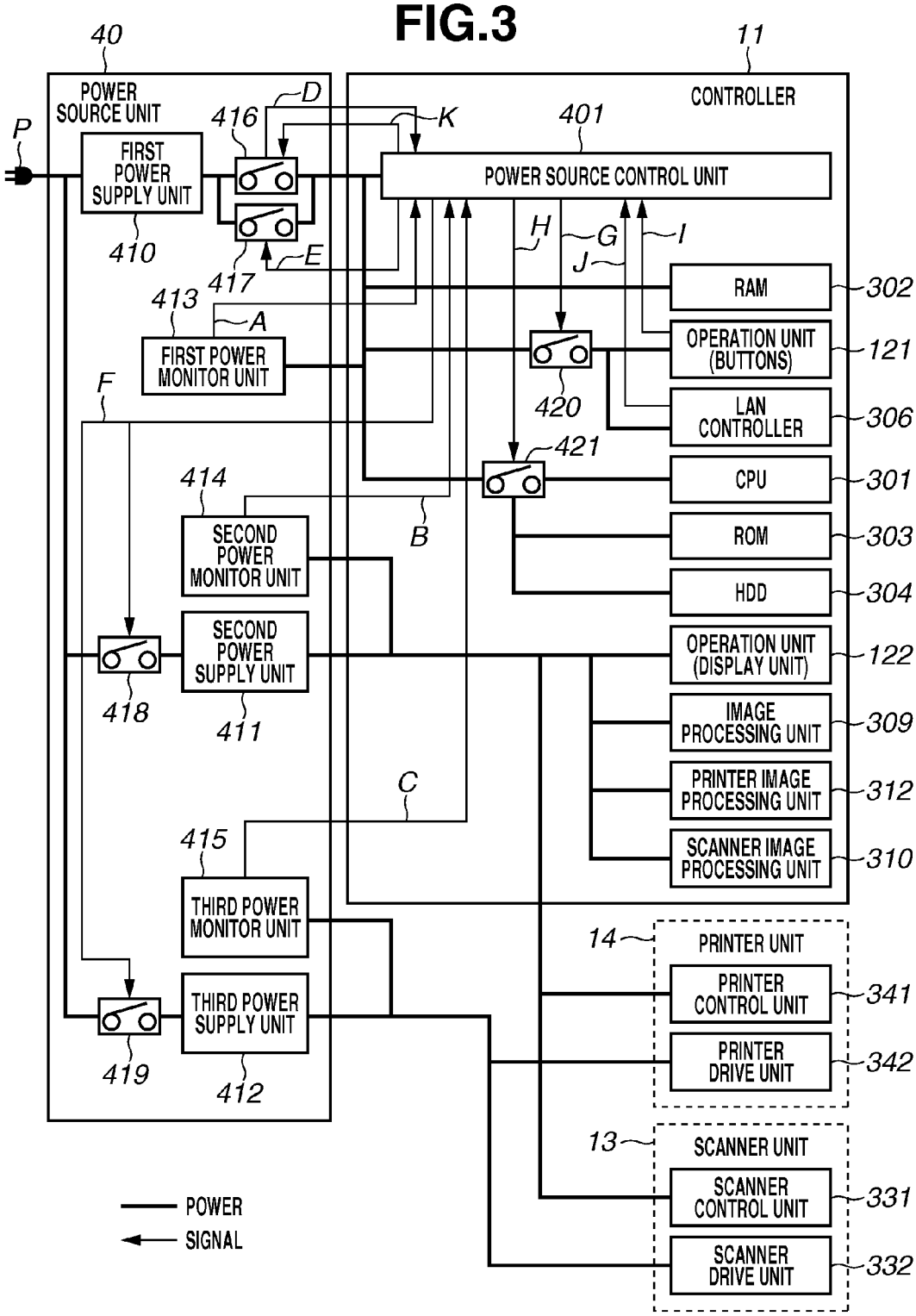
FIG. 3 is a power supply circuit diagram of the image forming apparatus.

FIG. 3 is a power supply circuit diagram for the image forming apparatus 10. Electric power generated by the power source unit 40 is supplied to each unit of the image forming apparatus 10 described above. The power source unit 40 includes a first power supply unit 410, a second power supply unit 411, a third power supply unit 412, a first power monitor unit 413, a second power monitor unit 414, and a third power monitor unit 415.

The first power supply unit 410 converts alternating-current (AC) power, which is supplied through a plug P, into direct-current (DC) power (first output power) (e.g., of 5.1 V). This DC power is supplied to devices of a first power supply system (i.e., the power source control unit 401, the CPU 301, the RAM 302, the ROM 303, the HDD 304, the LAN controller 306, and the buttons 121 of the operation unit 12). The second power supply unit 411 converts the AC power, which is supplied through the plug P, to DC power (second output power) (e.g., of 12 V). This DC power is supplied to devices of a second power supply system (i.e., the display unit 122 of the operation unit 12, the image processing unit 309, the scanner image processing unit 310, the printer image processing unit 312, the printer control unit 341 of the printer unit 14, and the scanner control unit 331 of the scanner unit 13). The third power supply unit 412 converts the AC power, which is supplied through the plug P, to DC power (e.g., of 24 V) and supplies power to devices of a third power supply system (i.e., the printer drive unit 342 and the scanner drive unit 332).

The first power monitor unit 413 monitors the output voltage of the first power supply unit 410. Upon detecting that the applied output voltage of the first power supply unit 410 exceeds a threshold, the first power monitor unit 413 outputs a power-good signal A, as a result of the monitoring, to the power source control unit 401.

The second power monitor unit 414 monitors the output voltage of the second power supply unit 411. Upon detecting that the applied output voltage of the second power supply unit 411 exceeds a threshold, the second power monitor unit 414 outputs a power-good signal B, as a result of the monitoring, to the power source control unit 401. The third power monitor unit 415 monitors the output voltage of the third power supply unit 412. Upon detecting that the applied output voltage of the third power supply unit 412 exceeds a threshold, the third power monitor unit 415 outputs a power-good signal C, as a result of the monitoring, to the power source control unit 401.

A power switch 416 is arranged between the first power supply unit 410 and the first power supply system devices (at the primary side of the first power supply unit 410). The switch is turned on/off through operation by the user. A signal D indicative of a state (on or off) of the power switch 416 is input to the power source control unit 401. A switch 417, constituted by a field-effect transistor (FET), is provided in parallel with the power switch 416. This switch 417 is turned from on to off, or from off to on, through a control signal E output from the power source control unit 401. The power switch 416 is provided with a solenoid (not illustrated). Voltage is applied to this solenoid in response to a control signal K output from the power source control unit 401 to turn off the power switch 416.

A relay switch 418 is provided between the plug P and the second power supply unit 411 (at the primary side of the second power supply unit 411). A relay switch 419 is provided between the plug P and the third power supply unit 412 (at the primary side of the third power supply unit 412). The relay switches 418 and 419 are turned from on to off, or from off to on, through a control signal F output from the power source control unit 401.

A switch 420 is provided between the power switch 416 and the buttons 121 of the operation unit 12, and the LAN controller 306. The switch 420 is turned from on to off, or from off to on, through a control signal G output from the power source control unit 401. Furthermore, a switch 421 (switching unit) is provided between the power switch 416 and the CPU 301, the ROM 303, and the HDD 304. The switch 421 is turned from on to off, or from off to on, through a control signal H output from the power source control unit 401.

<Power State of Image Forming Apparatus 10>

FIG. 4 is a power state transition diagram of the image forming apparatus 10. FIG. 5 is a diagram of the on/off states of the devices in different power states of the image forming apparatus 10. With reference to FIGS. 4 and 5, the power states of the image forming apparatus 10 will now be described. The image forming apparatus 10 may take a power-off state, a second sleep state, the first sleep state, or a standby state.

In the power-off state, power is not supplied to each unit of the image forming apparatus 10. The switches 416 to 421 illustrated in FIG. 3 are off in the power-off state. The power-off state may be a hibernation state. In the hibernation state, the switches 416 to 421 are off similarly to the power-off state. For the hibernation state, a state of the image forming apparatus 10 before the transition to the hibernation state is stored in the HDD 304. This enables the image forming apparatus 10, when resuming from the hibernation state, to resume quickly by using information stored in the HDD 304.

In the second sleep state, power is not supplied to each unit of the image forming apparatus 10 except the power source control unit 401, the RAM 302, the LAN controller 306, and the buttons 121 of the operation unit 12. In the second sleep state, power is supplied from the first power supply unit 410 to the power source control unit 401, the RAM 302, the LAN controller 306, and the buttons 121 of the operation unit 12. In the second sleep state, the switches 416, 417 and 420 illustrated in FIG. 3 are on, while the remaining switches 418, 419, and 421 are off. The second sleep state allows the operation through the buttons 121 of the operation unit 12 by the user to be accepted. The second sleep state also allows the LAN controller 306 to receive a packet transmitted from the external apparatus 20. In the second sleep state, the LAN controller 306, in place of the CPU 301 of the controller 11, returns a response to some specific packets transmitted from the external apparatus 20. Such a function of the LAN controller 306 is referred to as a proxy response. The proxy response performed by the LAN controller 306 allows a response to be provided to the specific packets transmitted from the external apparatus 20 in the second sleep state (without resuming from the sleep).

The first sleep state is a state for responding to inquiry and the like from the network 60 with activating not all the devices in the controller 11. When a packet (e.g., inquiry from the network 60) to which the LAN controller 306 cannot perform the proxy response is received from the external apparatus 20 in the second sleep state, the image forming apparatus 10 transitions from the second sleep state to the first sleep state. Power is supplied from the first power supply unit 410 to the CPU 301 and the HDD 304 in the first sleep state, and thus, the CPU 301 can return a response to the packet using information stored in the HDD 304. In the first sleep state, power is supplied to the power source control unit 401, the RAM 302, the LAN controller 306, the buttons 121 of the operation unit 12, the CPU 301, the ROM 303, and the HDD 304. In the first sleep state, power is not supplied to the second power supply system devices and the third power supply system devices. In the first sleep state, the switches 416, 417, 420, and 421 illustrated in FIG. 3 are on, while the switches 418 and 419 are off.

In the standby state, each function of the image forming apparatus 10, such as the printing processing and the scanner processing, can be executed. When the power switch 416 is turned from off to on in the power-off state or in a suspend state, the image forming apparatus 10 transitions to the standby state. The image forming apparatus 10 also transitions to the standby state when a page description language (PDL) print job is received from the external apparatus 20 in the second sleep state. In the standby state, power is supplied to each of the controller 11, the operation unit 12, the printer unit 14, and the scanner unit 13. More specifically, the switches 416 to 421 illustrated in FIG. 3 are on in the standby state.

The image forming apparatus 10 may be in another state other than the power-off state, the first sleep state, the second sleep state, and the standby state. More specifically, the image forming apparatus 10 may be in the suspend state. In the suspend state, power is not supplied to each unit of the image forming apparatus 10 except the power source control unit 401 and the RAM 302. In the suspend state, the switch 417 illustrated in FIG. 3 is on, while the other switches 416 and 418 to 421 are off. In the suspend state, a state of the image forming apparatus 10 before the transition to the suspend state is stored in the RAM 302, to which power supply is maintained. This enables the image forming apparatus 10 to resume quickly by using the state of the image forming apparatus 10 stored in the RAM 302.

With reference to FIG. 4, the power state transition of the image forming apparatus 10 will now be described.

When the power switch 416 is turned off in a state of the standby state, the image forming apparatus 10 transitions to the power-off state (see arrow (1) in FIG. 4).

When the power switch 416 is turned on in the power-off state, the image forming apparatus 10 transitions to the standby state (see arrow (2) in FIG. 4).

When a PDL print job is received from the external apparatus 20 in the first sleep state or the second sleep state, the image forming apparatus 10 transitions to the standby state (see arrow (3) in FIG. 4).

When a packet to which the LAN controller 306 cannot perform the proxy response is received or when one of the buttons 121 of the operation unit 12 is pressed in the second sleep state, the image forming apparatus 10 transitions to the first sleep state (see arrow (4) in FIG. 4).

When a predetermined time has elapsed with the buttons 121 of the operation unit 12 not operated and a predetermined time has elapsed with no PDL print job received in the first sleep state, the image forming apparatus 10 transitions to the second sleep state (see arrow (5) in FIG. 4).

When the power-saving button 121*c* of the operation unit 12 is pressed in the standby state, the image forming apparatus 10 transitions to the first sleep state (see arrow (6) in FIG. 4).

The power source control unit 401 will now be described in detail.

The power source control unit 401 is a complex programmable logic device (CPLD). The power source control unit 401 controls the transition of the image forming apparatus 10 to the power states described above. The power source control unit 401 is supplied with power in the second sleep state and thus can detect a factor in resuming from the second sleep state (e.g., pressing of one of the buttons 121 of the operation unit 12, and receiving of a packet to which the proxy response cannot be provided (a PDL print job,)). The factors in resuming from the second sleep state are not limited to the pressing of the buttons 121 and the receiving of a packet to which the proxy response cannot be performed. For example, the image forming apparatus 10, if provided with a fax function, may resume from the second sleep state upon receipt of a fax.

The power source control unit 401 communicates with the CPU 301 to turn the switches 417 to 421 on or off in response to a command from the CPU 301.

A wake signal J is input into the power source control unit 401 from the LAN controller 306. Upon receipt of a packet to which the LAN controller 306 cannot perform the proxy response (including a PDL print job) through the network 60, the LAN controller 306 outputs the wake signal J to the power source control unit 401. Upon receipt of the wake signal J, the power source control unit 401 turns on the switch 421. With the switch 421 on, the CPU 301 is activated to analyze the received packet. If the CPU 301 determines that a PDL print job is received, the CPU 301 causes the power source control unit 401 to output the control signal F to turn on the switches 418 and 419. If the received packet is a packet that can be responded to using information stored in the HDD 304, the power source control unit 401 does not output the control signal F. Thus, the switches 418 and 419 are not turned on.

A wake signal I is also input into the power source control unit 401 from the buttons 121 of the operation unit 12. Upon pressing one of the buttons 121 of the operation unit 12 by the user, the operation unit 12 outputs the wake signal I to the power source control unit 401. Upon receipt of the wake signal I, the power source control unit 401 turns on the switch 421. The display unit 122 of the operation unit 12 may be turned on when one of the buttons 121 of the operation unit 12 is pressed by the user.

<Operation of Power Source Control Unit 401>

Figure 6:
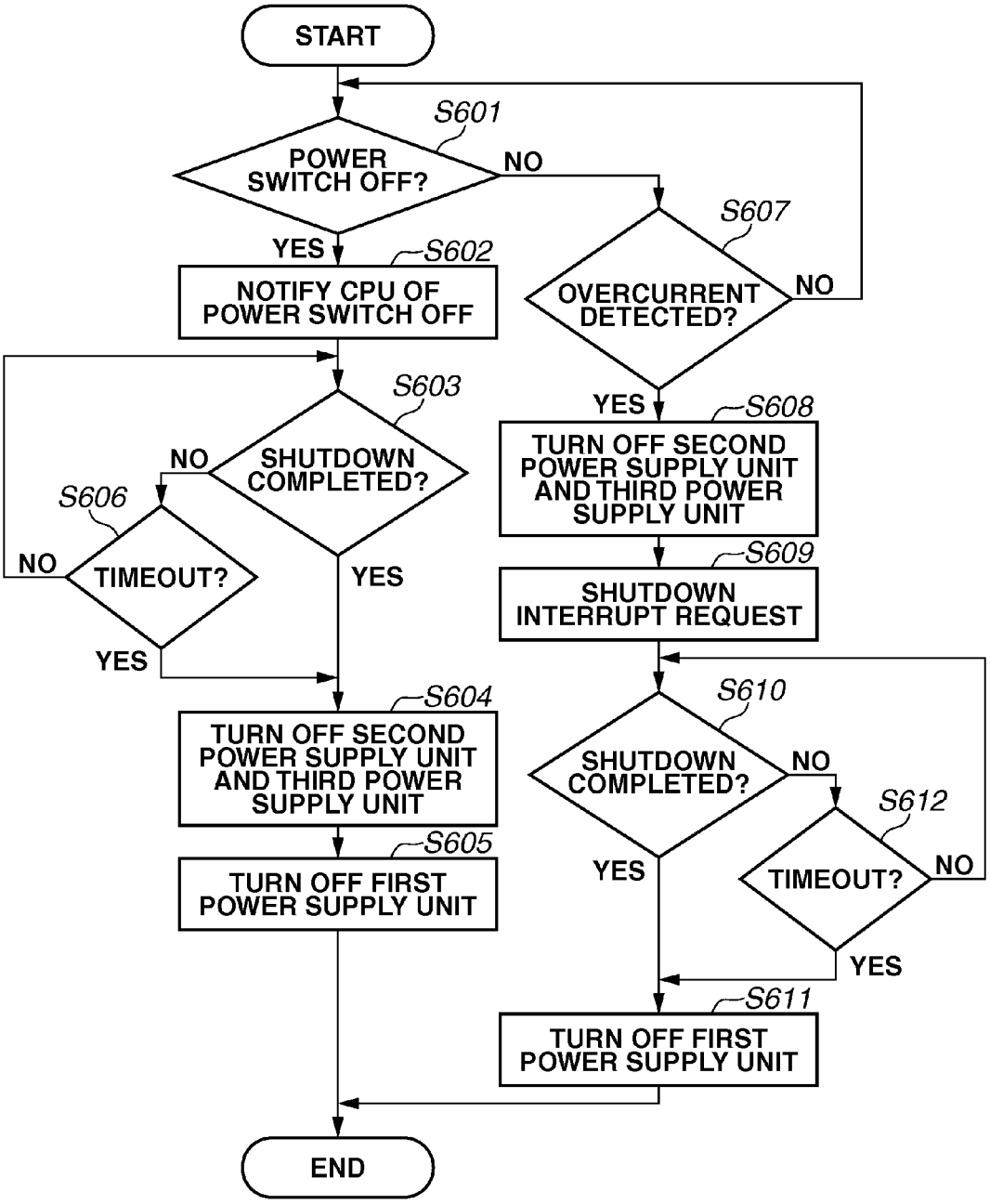
FIG. 6 is a flowchart illustrating processing executed by a power source control unit.

With reference to FIG. 6, an operation executed by the power source control unit 401 will now be described.

If the power switch 416 is turned from on to off through the operation by the user (YES in step S601), the signal D indicative of the state of the power switch 416 becomes Lo. In step S602, the power source control unit 401 notifies the CPU 301 that the power switch 416 is off in response to the signal D, which is being input into the power source control unit 401, having become Lo. The CPU 301 executes shutdown processing in response to the notification. The shutdown processing executed by the CPU 301 will be described below.

In step S603, the power source control unit 401 determines whether the shutdown processing executed by the CPU 301 has been finished. Upon finishing of the shutdown processing, the CPU 301 transmits a shutdown finish notification to the power source control unit 401. If the notification is received (YES in step S603), the power source control unit 401 determines that the shutdown processing has been finished. If the shutdown processing has been finished, then in step S604, the power source control unit 401 stops outputting the control signal F to turn off the switches 418 and 419. This causes the second power supply unit 411 to stop supplying power to the second power supply system devices, and the third power supply unit 412 to stop supplying power to the third power supply system devices. As a result, the second power monitor unit 414 stops outputting the power-good signal B, and the third power monitor unit 415 stops outputting the power-good signal C. With the output of the power-good signals B and C stopped, then in step S605, the power source control unit 401 stops outputting the control signal E to turn off the switch 417. This causes the first power supply unit 410 to stop supplying power to the first power supply system devices. This results in stopping of power supply to each unit of the image forming apparatus 10.

If the power source control unit 401 does not receive the shutdown finish notification from the CPU 301 after the elapse of a predetermined time since the power switch 416 has been turned off (YES in step S606), the power source control unit 401 stops outputting the control signals F and E. This stops power supply to each unit of the image forming apparatus 10 even if the shutdown processing cannot be completed due to any reason including a freeze of the CPU 301.

In step S607, the power source control unit 401 determines whether an overcurrent has been detected. If the second power monitor unit 414 has detected an overcurrent, the second power monitor unit 414 stops outputting the power-good signal B. If the third power monitor unit 415 has detected an overcurrent, the third power monitor unit 415 stops outputting the power-good signal C. The power source control unit 401 determines that an overcurrent has been detected if the output of the power-good signal B or the power-good signal C is stopped. If an overcurrent has been detected (YES in step S607), then in step S608, the power source control unit 401 stops outputting the control signal F to turn off the switches 418 and 419. In step S609, the power source control unit 401 makes an interrupt request to the CPU 301 to perform the shutdown processing. In step S610, the power source control unit 401 determines whether the shutdown processing executed by the CPU 301 has been finished. The power source control unit 401 determines that the shutdown processing has been finished if a shutdown finish notification has been received. If the shutdown processing has been finished (YES in step S610), then in step S611, the power source control unit 401 stops outputting the control signals E and K. With the output of the control signal E stopped, the switch 417 is turned off. With the output of the control signal K, voltage is applied to the solenoid of the power switch 416. This drives the solenoid to turn off the power switch 416. This stops the power supply to the constituents of the image forming apparatus 10.

If the power source control unit 401 does not receive the shutdown finish notification from the CPU 301 after the elapse of a predetermined time since the power switch 416 has been turned off (YES in step S612), the power source control unit 401 stops outputting the control signals E and K. This stops the power supply to each unit of the image forming apparatus 10 even if the shutdown processing cannot be completed due to reasons including a freeze of the CPU 301.

<Operation of CPU 301>

Figure 7:
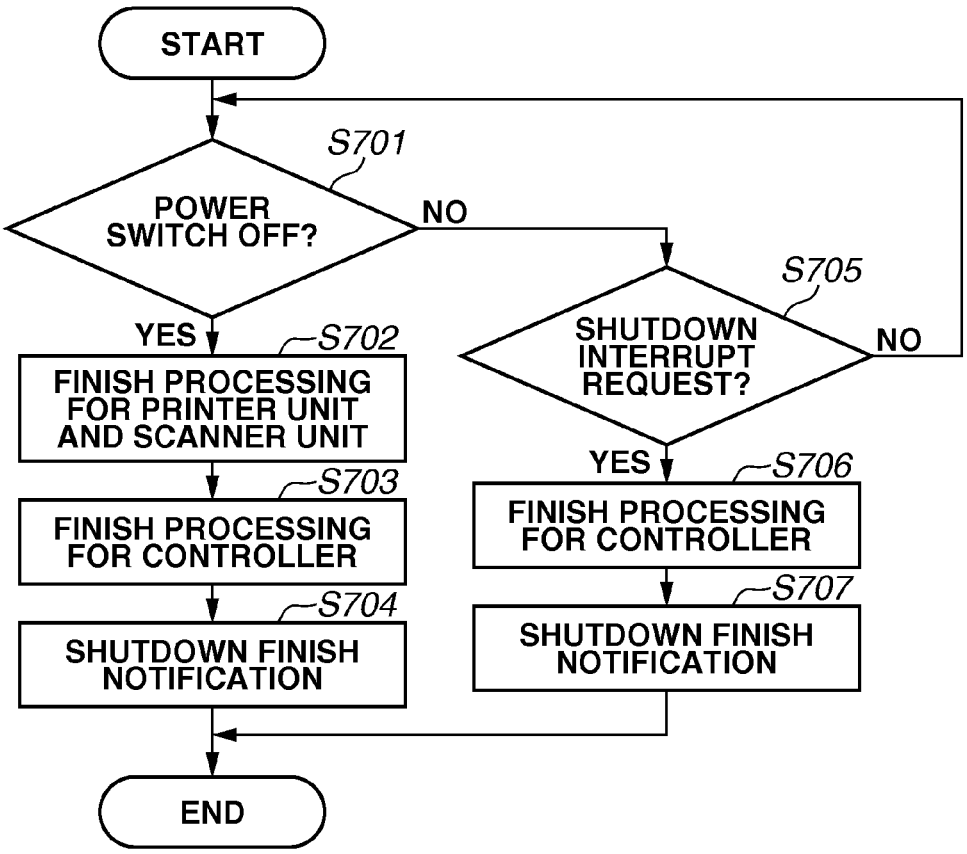
FIG. 7 is a flowchart illustrating shutdown processing executed by a CPU of the controller.

With reference to FIG. 7, the shutdown processing performed by the CPU 301 will now be described.

The CPU 301 performs the shutdown processing, when the power switch 416 is turned from on to off, or when an overcurrent is detected.

If the power switch 416 is turned from on to off (YES in step S701), then in step S702, the CPU 301 performs finish processing for the printer unit 14 and the scanner unit 13. When the power switch 416 is turned from on to off, the power source control unit 401 notifies the CPU 301 that the power switch 416 has been turned off. In step S701, the CPU 301 determines that the power switch 416 is turned off according to the notification. If the power switch 416 is turned off, then in step S702, the CPU 301 finishes an application to control the printer unit 14 and an application to control the scanner unit 13. In step S703, the CPU 301 performs the finish processing for the controller 11. Upon finishing of the shutdown processing, then in step S704, the CPU 301 transmits a shutdown finish notification to the power source control unit 401.

In a case where the power switch 416 is not turned off (NO in step S701), if an overcurrent is detected and the power source control unit 401 makes an interrupt request for the shutdown (YES in step S705), the CPU 301 executes the shutdown processing. In the present exemplary embodiment, the CPU 301 does not perform the finish processing for the printer unit 14 and the scanner unit 13. With the occurrence of the overcurrent, the power source control unit 401 has shut off power supply to the printer unit 14 and the scanner unit 13, and thus, the CPU 301 does not perform the finish processing for the printer unit 14 and the scanner unit 13. In step S706, the CPU 301 executes the finish processing for the controller 11. Upon finishing of the shutdown processing, then in step S707, the CPU 301 transmits a shutdown finish notification to the power source control unit 401.

The CPU 301 may notify the user of the occurrence of the overcurrent before executing the shutdown processing in response to the interrupt request for the shutdown by the power source control unit 401.

In the present exemplary embodiment described above, the CPU 301 is separated from the second power supply unit 411 and the third power supply unit 412. Therefore, if the occurrence of an overcurrent at the second power supply unit 411 or the third power supply unit 412 turns off the switches 418 and 419, the CPU 301 is supplied with power from the first power supply unit 410. The CPU 301 is, therefore, capable of performing the shutdown processing for the controller 11. As described above, even with the occurrence of an overcurrent, data saving processing can be performed before power supply to the CPU 301 is stopped in the present exemplary embodiment.

Additionally, in the exemplary embodiment, an occurrence of an overcurrent at the second power supply unit 411, which generates 12 V, or the third power supply unit 412, which generates 24 V, would lead to increased load to the second power supply system devices and the third power supply system devices. In the present exemplary embodiment, power supply to the second power supply unit 411 and the third power supply unit 412 is shut off immediately at the occurrence of the overcurrent. With this operation, load to be applied to the second power supply system devices and the third power supply system devices can be reduced.

In the present exemplary embodiment, the power supply system for the CPU 301 of the controller 11, which executes the shutdown processing, is independent from the power supply systems for the printer unit 14 and the scanner unit 13. This allows power supply to the second power supply system devices and the third power supply system devices to be shut off in response to an overcurrent occurrence thereof without shutting off power supply to the CPU 301 of the controller 11.

<Other Exemplary Embodiments>

Although the invention has been described in detail based on preferred exemplary embodiments, the invention is not limited to these specific exemplary embodiments. The invention also includes various modifications to be made without departing from the spirit of the invention. Additionally, parts of the exemplary embodiments described above may be combined as appropriate.

In the above-described exemplary embodiments, an example has been described in which the power source control unit 401, which is a hardware logic circuit, executes the steps illustrated in FIG. 6, but the invention is not limited thereto. The power source control unit 401 may be a processor, and may execute a program to carry out the steps in FIG. 6.

Although the exemplary embodiments described above include the second power monitor unit 414 and the third power monitor unit 415, any one of the power monitor units may be provided.

Functions illustrated in the flowcharts described above in the exemplary embodiments may be implemented by a processing apparatus (a CPU or a processor) of a computer, a personal computer, or the like executing software (a program) acquired through a network or any of various types of storage media.

According to the exemplary embodiments described above, in a case where an overcurrent flows from the second power supply unit, the second power supply unit stops supplying power and a control unit supplied with power from the first power supply unit can execute the finish processing to prevent loss of data.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-136175 filed Jun. 28, 2013, which is hereby incorporated by reference herein in its entirety.

What is claimed is:

1. An image forming apparatus, comprising:

a first power supply unit configured to output first output power;

a first device to which the first output power is supplied from the first power supply unit;

a second power supply unit configured to output second output power;

a second device to which the second output power is supplied from the second power supply unit;

a detection unit configured to detect an overcurrent of the second power supply unit;

a power source control unit to which the first output power is supplied from the first power supply unit, and configured to switch between supplying and shutting-off of the second output power to the second device; and a control unit to which the first output power is supplied from the first power supply unit, and configured to control an operation of the first device, wherein, when the detection unit detects an overcurrent of the second output power, the power source control unit shuts off the second output power from the second power supply unit to the second device, and the control unit executes finish processing for the first device.

2. The image forming apparatus according to claim 1, wherein the detection unit detects an overcurrent when voltage output from the second power supply unit is lower than a threshold.

3. The image forming apparatus according to claim 1, wherein, when the detection unit detects an overcurrent of the second output power, the control unit does not execute finish processing for the second device.

4. The image forming apparatus according to claim 1, wherein, when the detection unit detects an overcurrent of the second output power, the power source control unit notifies the control unit thereof, and wherein the control unit executes the finish processing for the first device according to the notification from the power source control unit.

5. The image forming apparatus according to claim 1, further comprising a switch provided at a primary side of the first power supply unit, and configured to become an on-state or an off-state according to an operation by a user, wherein the power source control unit controls the switch to become the off-state after the finish processing for the first device has been executed.

6. The image forming apparatus according to claim 5, wherein, when the switch becomes from the on-state to the off-state by the operation of the user, the control unit executes the finish processing for the first device and the second device.

7. The image forming apparatus according to claim 1, wherein the second power supply unit generates the second output power of DC using input AC power.

8. The image forming apparatus according to claim 1, wherein the second device includes at least one of a printer unit for forming an image on a sheet, and a scanner unit for scanning an image on a document.

9. The image forming apparatus according to claim 1, wherein the power source control unit is a complex programmable logic device.

10. The image forming apparatus according to claim 1, wherein the control unit is a central processing unit.

11. The image forming apparatus according to claim 1, wherein the first device includes a hard disk drive.

12. The image forming apparatus according to claim 8, wherein the control unit controls an operation of at least one of the printer unit and the scanner unit.

* * * * *